US007743575B2

(12) United States Patent
Ito

(10) Patent No.: US 7,743,575 B2
(45) Date of Patent: Jun. 29, 2010

(54) JOINT MEMBER

(75) Inventor: Hiroshi Ito, Nagoya (JP)

(73) Assignee: Nichiha Co., Ltd., Nagoya-shi (JP)

( * ) Notice: Subject to any disclaimer, the term of this patent is extended or adjusted under 35 U.S.C. 154(b) by 345 days.

(21) Appl. No.: 11/409,265

(22) Filed: Apr. 24, 2006

(65) Prior Publication Data

US 2007/0256386 A1 Nov. 8, 2007

(51) Int. Cl.
*E04B 2/06* (2006.01)
*E04F 13/072* (2006.01)
*E04F 13/076* (2006.01)

(52) U.S. Cl. ..... 52/582.1; 52/461; 52/463; 52/464; 52/468; 52/772

(58) Field of Classification Search ..... None
See application file for complete search history.

(56) References Cited

U.S. PATENT DOCUMENTS 2,803,858 A * 8/1957 Rader ..... 52/464
3,147,336 A * 9/1964 Mathews ..... 174/371
4,516,373 A * 5/1985 Osawa ..... 52/387
4,910,938 A * 3/1990 McGee ..... 52/481.2
5,076,035 A * 12/1991 Wright ..... 52/464
5,125,204 A * 6/1992 Porter ..... 52/393
5,287,675 A * 2/1994 McGee ..... 52/770
5,918,437 A * 7/1999 Dobija ..... 52/506.01
6,155,014 A * 12/2000 Wagner ..... 52/281
6,253,516 B1 * 7/2001 D'Andrea et al. ..... 52/582.1
6,374,561 B1 * 4/2002 Ishiko ..... 52/506.01
6,427,405 B1 * 8/2002 Moriya et al. ..... 52/396.04
6,588,165 B1 * 7/2003 Wright ..... 52/506.05
6,688,060 B2 * 2/2004 Sawada ..... 52/309.13
6,988,344 B1 * 1/2006 Krueger ..... 52/464

FOREIGN PATENT DOCUMENTS

JP 2000-160804 6/2000

* cited by examiner

*Primary Examiner*—Brian E Glessner
*Assistant Examiner*—Jason Holloway
(74) *Attorney, Agent, or Firm*—Edwards Angell Palmer & Dodge LLP

(57) ABSTRACT

A joint member capable of forming a joint portion that can be easily constructed and has an excellent design and a high waterproof capacity even if it is manufactured at a low cost. A joint member 1 is composed of a hat joiner 10 and a joint cover 20, and the hat joiner 10 is composed of a base plate 11 to be fastened to the body side of building frame and a convex portion 12 protruding from the base plate 11 to the surface side. The joint cover 20 is provided with a joint groove portion 21 that covers a top surface 12*c* of the convex portion 12 in the course of construction, and a lower edge portion 23 extending from the lower end of the joint groove portion 21 and brought into contact with the surface of an external wall panel 30B in the course of construction. An elastic water proof material 26 is attached to the rear surface of the lower edge portion 23.

6 Claims, 8 Drawing Sheets

JOINT MEMBER

BACKGROUND OF THE INVENTION

1. Field of the Invention

The present invention relates to a joint member that is fixed between the vertically adjacent external wall panels when an external wall panel is fastened to an external wall portion of a building.

2. Description of the Related Art

In order to improve a design of the external wall of a building, an external wall panel such as fiber reinforced cement siding having a surface pattern of, for example, a natural stone style or a brick style, is fastened to the external wall portion of the building. As a manner of fastening an external wall panel to a side of the building frame, there is a method called a horizontal boarding to put the longitudinal side of the panel in a lateral (horizontal) direction. Another method called a vertical boarding calls for fastening the panel with its longitudinal side put in a vertical direction (from up to down). The external wall panels used for the vertical boarding normally have flat upper and lower end surfaces, and shiplap portions at the right and left ends. Thus external wall panels adjacent to each other at their right and left ends are joined edge by edge via the shiplap portions. On the other hand, joining the external wall panels adjacent to each other vertically requires an appropriate member that intervenes between the ends of the external wall panels.

FIG. 7 is a cross sectional view showing an example of a joint portion between upper and lower external wall panels fastened by vertical boarding. This example shows that the vertically adjacent external wall panels 30A, 30B are fastened to a lateral furring strip 91 by means of a nail 95 while a convex portion 42 of a hat joiner 40 is sandwiched between the said external wall panels. A sealing material 97 is filled over the hat joiner 40. The lateral furring strip 91 is fixed to a post or a stud (not illustrated) via a building paper 93. The hat joiner 40 is composed of a base plate 41 that serves as a fixed surface to the lateral furring strip 91 and the convex portion 42 that protrudes to the surface side of the base plate 41, and by using this hat joiner 40, a desired space is formed between the upper and lower external wall panels 30A and 30B.

FIG. 8*a* shows another construction example of a vertical boarding. According to this construction example, the upper and lower external wall panels 30A and 30B are fastened with an intermediate throating 50 sandwiched therebetween. The intermediate throating 50 is composed of a base plate 51 that serves as a fixed surface to the lateral furring strip 91, a step portion 52 that is formed at the lower end of the base plate 51, and a throating portion 53 that extends from the lower end of the step portion 52 to the surface side. As shown in the drawing, the lower end of the upper external wall panel 30A is mounted on the step portion 52 of the intermediate throating 50 with the throating portion 53 protruding from the space between the upper and lower external wall panels 30A and 30B to the surface side. Then, the external wall panels 30A and 30B are fixed to the lateral furring strip 91, with nails 95 driven through the surfaces of said external wall panels.

Further, as an example similar to the intermediate throating 50, an intermediate throating without the step portion 52 is also used in many cases.

FIG. 8*b* shows still another construction example of a vertical joint portion (refer to Patent document 1). In FIG. 7 and FIG. 8*a*, the external wall panels 30A and 30B are fastened by using the nail 95, however, in the construction example shown in FIG. 8*b*, an intermediate throating 60 fixed between the upper and lower external wall panels 30A and 30B holds the upper and lower ends of said panels 30A and 30B, and fastening members (not illustrated) fasten the right and left shiplap portions of the external wall panels 30A and 30B so as to fix said panels at the side of the building frame. The intermediate throating 60 consists of a base plate 61 that serves as a fixed surface to the lateral furring strip 91, and a support plate 62 and a throating portion 64 that extend from the base plate 61 toward the surface side to form two front surface plates 63 and 65 extending upwards and downwards respectively from the front ends of these support plate 62 and throating portion 64. As shown in the drawing, the support plate 62 and the front surface panel 63 cover and hold the lower end of the upper external wall panel 30A. In addition, the throating portion 64 and the front surface plate 65 cover the upper end of the lower external wall panel 30B.

[Patent document 1] Japanese Patent Application Laid-Open No. 2000-160804

The construction structure shown in FIG. 7 has a problem with a decay durability of the sealing material 97, and it is feared that rain water penetrates through the sealing material 97 and may causes a separation phenomenon of the sealing material 97. In addition, the sealing material 97 is filled between the upper and lower external wall panels 30A and 30B, making it difficult to form a joint groove portion with a depth, causing a problem with a design of the joint groove portion.

In the construction structure shown in FIG. 8*a*, it is necessary to adjust the positions of the external wall panel to obtain a desired certain width of the joint portion that, in other words, amount to the interval between the upper and lower ends of the external wall panels 30A and 30B, and this proved troublesome in performing the construction work. In addition, the throating portion 53 of the intermediate throating 50 covers the front surface of the upper end of the lower external wall panel 30B and a joint groove portion that is well-shaped in a horizontally straight line is hard to obtain. As a result, the appearance of the surface patterns of the upper and lower external wall panels 30A and 30B is divided by the throating portion 53.

In the construction structure shown in FIG. 8*b*, the shape of the intermediate throating 60 is complicated, and in order to support the weight of the upper external wall panel 30A, it is necessary to make the intermediate throating 60 into an aluminum molded item and its manufacturing cost is expensive. Further, in order to hold the vicinity of the lower end of the external wall panel 30A stably, it is necessary for the upper front surface plate 63 to have a relatively large width and consequently, the width of the lower front surface panel 65 is also exposed largely to the front surface of the upper end of the external wall panel 30B. As a result, the appearance of the surface patterns of the upper and lower external wall panels 30A and 30B is clearly divided.

SUMMARY OF THE INVENTION

The present invention has been made taking the foregoing problems into consideration and an object thereof is to provide a joint member capable of forming a joint member that can be easily constructed and has an excellent design and a high waterproof performance even if it is manufactured at a low manufacturing cost.

In order to solve the above-described problems, the present invention provides a joint member that is fixed between vertically adjacent external wall panels in an external wall construction for fastening an external wall panel to a side of the building frame by driving a fixture from the surface side, at least comprising: a lower edge portion that is brought into contact with the vicinity of the upper end on the surface of the lower external wall panel in the course of construction; and a joint groove portion that extends from the upper end of the lower edge portion to the upside and the rear surface side.

In the external wall construction structure using the joint member according to the present invention, the lower edge of the joint member is exposed before the front surface of the external wall panel. However, this lower edge portion has close contact with the surface of the external wall panel unlike the throating portion 53 shown in FIG. 8*a*. Therefore, it is possible to sufficiently prevent rain water from leaking even if the lower edge portion has a small width. Accordingly, although the lower edge portion of the joint member is exposed, the width thereof is very small and the lower edge portion of the joint member is less noticeable. In addition, since the joint member according to the present invention can form a joint groove portion with a depth, it is possible to obtain a joint member of a high-grade design. In addition, it is possible to prevent the joint portion of the upper and lower external wall panels from rain water leakage. Since the joint member according to the present invention can be formed in a simple shape, it can be manufactured easily. Further, since there is no need to support the weight of the external wall panel unlike the intermediate throating 60 shown in FIG. 8*b*, the material of low cost can be used.

It is preferable to attach an elastic waterproof material to the rear surface of the lower edge portion, in that it would increase the adhesion of the lower edge portion to the external wall panel, assuring better rainwater proof capacity.

According to a preferable embodiment, the joint member comprises a hat joiner and a joint cover, said hat joiner comprising a base plate that serves as a fixed surface against a side of the building frame, and a convex portion that protrudes from the base plate toward the surface side being sandwiched between the ends of the upper and lower external wall panels in the course of construction. The joint cover at least comprises the joint groove portion and the lower edge portion; and the joint groove portion is formed into a shape that can cover at least the top surface of the hat joiner convex portion and the upper end surface of the lower external wall panel while the joint member and the upper and lower external wall panels are fastened to each other. The joint member in this embodiment is capable of providing a desired interval between the upper and lower external wall panels with the help of the hat joiner. In other words, the width of the joint can be kept at a desired level constantly. Furthermore, it is possible to obtain hat joiners and joint covers in so simple shapes that they can be manufactured easily.

It is preferable that when the joint member and the upper and lower external wall panels are in the state of being fastened to each other, the joint groove portion of the joint cover is formed in such a size that part of said joint groove portion may come into contact with the top surface of the hat joiner convex portion. In this way, it is possible to make the joint groove portion as deep as possible. In addition, it is possible to prevent rain water leakage from the space between the joint groove portion and the hat joiner convex.

According to a preferable embodiment, when the joint member and the upper and lower external wall panels are in the state of being fastened to each other, the joint groove portion of the joint cover is formed in such a shape as to cover the lower end surface of the upper external wall panel. The joint cover further extends upward from the upper end of said joint groove portion, and is provided with an upper edge portion that comes into contact with the surface of the upper external wall portion in the course of construction. An elastic water proof material is attached to the rear surface of the upper edge portion. In the present embodiment, the entire joining portion of the upper and lower external wall panels can be covered with the joint cover without exposing the end surfaces of the external wall panels. As a result, the external wall panels have desirable appearances. Further, in the external wall construction structure using the joint member according to the present embodiment, the upper edge, in addition to the lower edge, of the joint cover is exposed to the front surface of the external wall panel. This upper edge does not serve to hold the end of the external wall panel unlike the upper front surface panel 63 shown in FIG. 8*b*, with the result that the upper edge can be made to have a small width which is less noticeable.

According to another preferable embodiment, when the joint member and the upper and lower external wall panels are in the state of being fastened to each other, the joint groove portion of the joint cover is in a shape to cover only the top surface of the hat joiner convex portion and the upper end surface of the lower external wall panel. The joint cover further comprises a protruding portion that extends from the upper end of the joint groove portion to the rear surface side and overlaps on the upper side surface at the upside of the hat joiner convex portion in the course of construction. When the exterior wall panel is fastened, a vertical joint running in a vertical direction may exist above the joint member depending on a position and rain water may fall on the joint member moving down this vertical joint. However, according to the joint cover of the present embodiment, even if the vertical joint is made to have a deep groove, the fallen rain water may further flow down along the surface of the joint cover. In other words, rain water does not stay near the joint member and the water proof performance of the joint cover is advanced.

It is preferable that the hat joiner and the joint cover are formed by the metal sheet processing of a single steel respectively and they can be manufactured easily.

According to still another preferable embodiment of the present invention, part of the joint groove portion serves as a fixed surface to a side of the building frame. The joint member according to the present member is made of a single steel sheet and the product shape is also simple. Further, the joint member in the present embodiment can be manufactured at a low cost. More preferably, if the joint member is formed by the metal sheet processing of a single steel sheet, the joint member can be manufactured easily.

DESCRIPTION OF THE PREFERRED EMBODIMENTS

As described above, the present invention provides a joint member that, according to the present invention, is easy to process for construction and good in design appearance and high level water proof capacity despite a low manufacturing cost.

Figure 1:
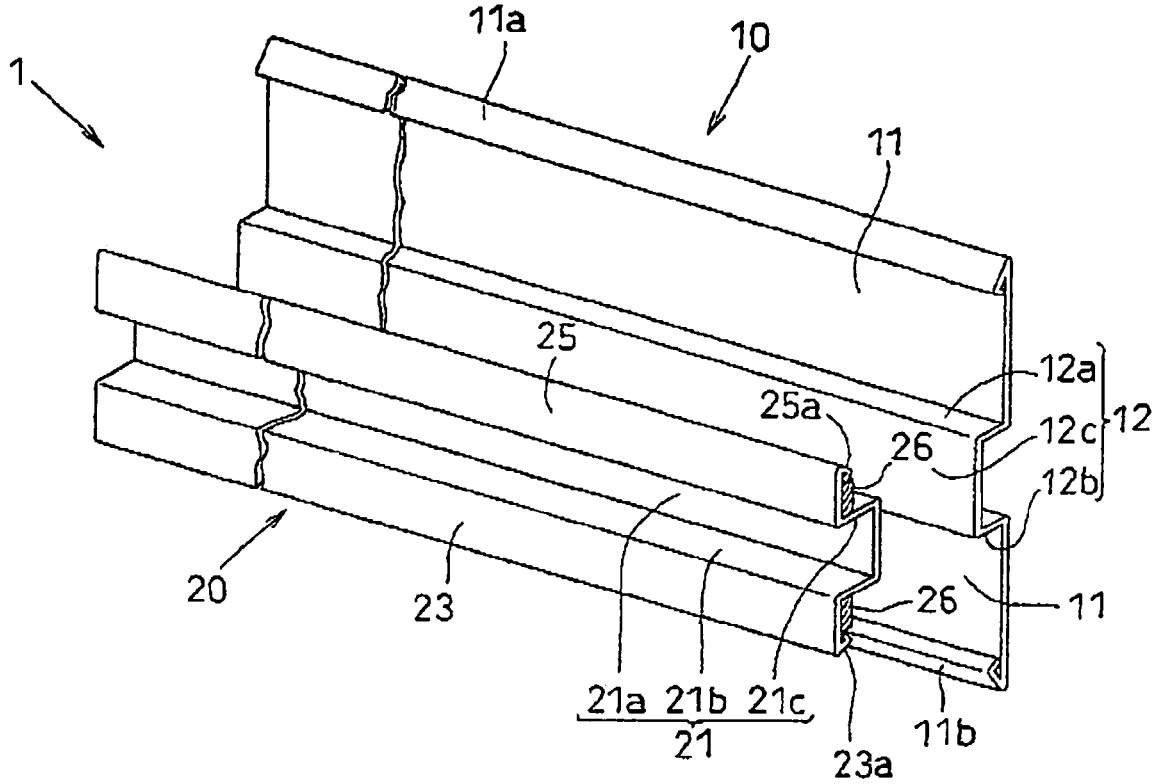
FIG. 1 is a perspective view showing a joint member according to an embodiment of the present invention.
Figure 2A:
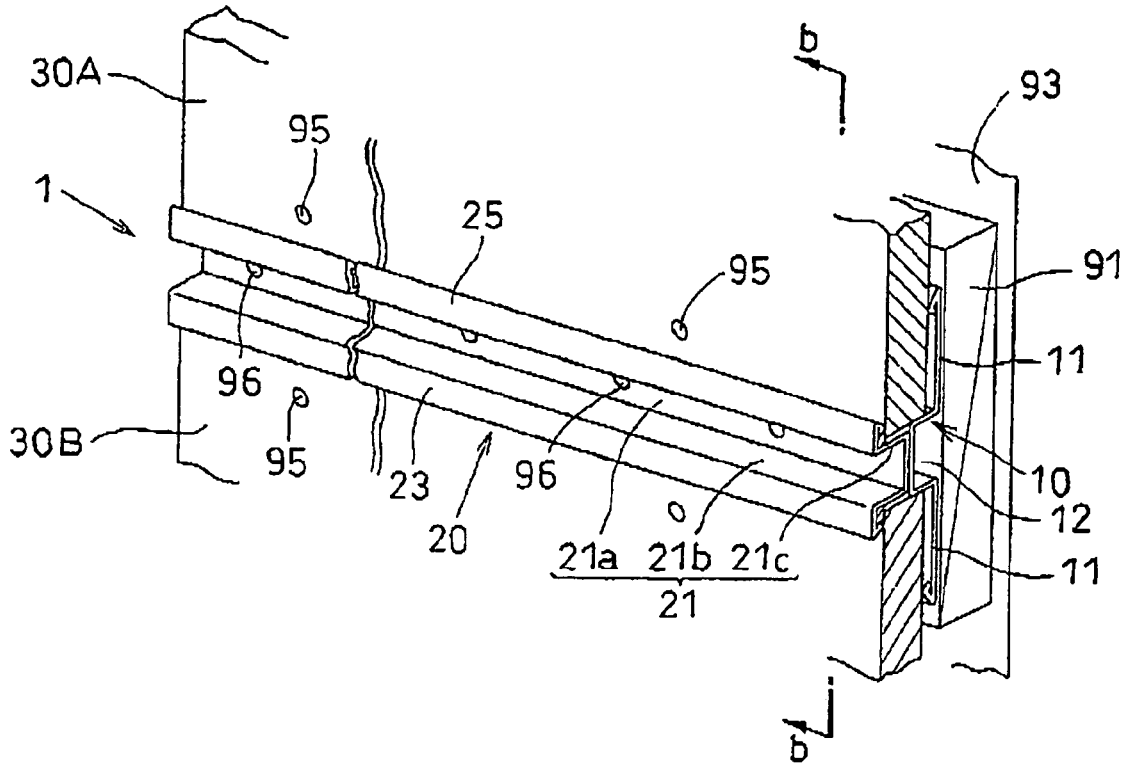
FIG. 2*a* is a perspective view showing a construction structure using the joint member shown in FIG. 1.
Figure 2B:
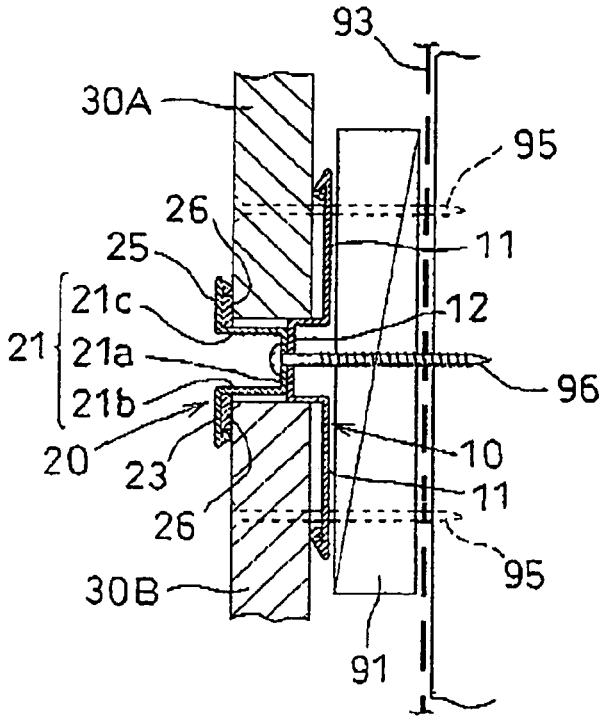
FIG. 2*b* is a cross sectional view taken along the line b-b shown in FIG. 2*a*.

With reference to the drawings, a preferable embodiment of the present invention will be described below. FIG. 1 is a perspective view showing a joint member according to an embodiment of the present invention. FIG. 2*a* is a perspective view showing a construction structure using the joint member shown in FIG. 1. FIG. 2*b* is a cross sectional view taken along line b-b shown in FIG. 2*a*.

In the external wall construction structure shown in FIG. 2, the external wall panels 30A and 30B are fastened to the lateral furring strip 91 by means of the nail 95 driven from the surface side, and a joint member 1 is fixed between the upper and lower external wall panels 30A and 30B. The joint member 1 is composed of two members shown in FIG. 1, namely, a hat joiner 10 and a joint cover 20. Any of them is formed by the processing of plate metal of one sheet of a steel plate.

First, the hat joiner 10 is composed of a base plate 11 that serves as a fixed surface to the lateral furring strip 91, and a convex portion 12 that is formed by folding down the vicinity of the center of the base plate 11 to the surface side. The convex part 12 is composed of upper and lower side surfaces 12*a* and 12*b*, and a top surface 12*c* that couples these upper and lower side surfaces 12*a* and 12*b* with each other. The upper and lower side surfaces 12*a* and 12*b* are separated at a distance equivalent to the interval to be formed between the ends of the external wall panels 30A and 30B that are vertically positioned next to each other. In addition, in order to increase the strength, vertical side end parts 11*a* and 11*b* of the base plate 11 are folded down to the surface side.

Next, the joint cover 20 is provided with a vertical plate 21*a* and a joint groove portion 21 composed of an upper plate 21*c* and a lower plate 21*b* that extend from the upper and lower ends thereof to the surface side. The upper plate 21*c* and the lower plate 21*b* are separated at a width that is slightly smaller than the interval of the upper and lower side surfaces 12*a* and 12*b* of the hat joiner convex portion 12 so as to get inserted easily between the upper and lower external wall panels 30A and 30B in the course of construction and provide the joint member with a natural appearance. Further, the joint cover 20 is also provided with an upper edge portion 25 and a lower edge portion 23 that extend from the upper end and the lower end of the joint groove portion 21 to the upside and downside, respectively. The upper edge portion 25 and the lower edge portion 23 are positioned on the same plane, and in order to increase the strength, respective side end portions 25*a* and 23*a* are folded down to the rear surface side. In addition, an elastic waterproof material 26 made of an EPDM rubber foam like a flat plate is attached to almost throughout the rear surfaces of these upper edge portion 25 and lower edge portion 23.

Upon manufacturing the joint cover 20, a steel sheet as material is bent and folded into a piece of a U-Shaped cross section before having it formed into the joint groove portion 21. The front ends of the upper plate 21*c* and the lower plate 21*b* are folded upward and downward, respectively, to obtain the upper edge portion 25 and the lower edge portion 23, respectively. Finally, the entire surface of the joint cover 20 is coated with a desired joint color.

Next, an external wall construction method using the above-described joint member 1 is described below. At first, the external wall panel 30B overlaps from above the base plate 11 of the lower portion of the hat joiner 10 by bringing the upper end surface of the lower external wall panel 30B into contact with the lower side surface 12*b* of the hat joiner convex portion 12. In this state, the external wall panel 30B is fastened to the lateral furring strip 91 by means of the nail 95 driven from the surface side of the panel. Next, by bringing the lower end surface of the upper external wall panel 30A into contact with the upper side surface 12*a* of the hat joiner convex portion 12, the upper external wall panel 30A is made to overlap the upper base plate 11 of the hat joiner 10 from above. In this state, the upper external wall panel 30A is fastened to the lateral furring strip 91 by means of the nail 95 driven from the surface side of said panel. Since the height of the hat joiner convex part 12 is smaller than the thicknesses of the external wall panels 30A and 30B, in this state, the surfaces of the external wall panels 30A and 30B protrude to the front surface further than the top surface 12*c* of the hat joiner convex portion 12 does. Finally, the vertical plate 21*a* of the joint groove portion 21 of the joint cover 20 is brought into contact with the top surface 12*c* of the hat joiner convex portion 12, and the rear surfaces of the upper edge portion 25 and the lower edge portion 23 are brought into contact with the surfaces of the upper and lower external wall panels 30A and 30B, respectively, and in this state, a screw 96 is screwed into the vertical plate 21*a* to fasten the joint cover 20 to the lateral furring strip 91. In the external wall construction structure that is formed in this way, as shown in FIG. 2*a*, the upper and lower joint portions of the upper and lower external wall panels 30A and 30B are entirely covered with the joint cover 20 and the end surfaces of the external wall panels 30A and 30B are not exposed to the surface. As a result, the external wall panels 30A and 30B have preferable appearances.

Figure 3:
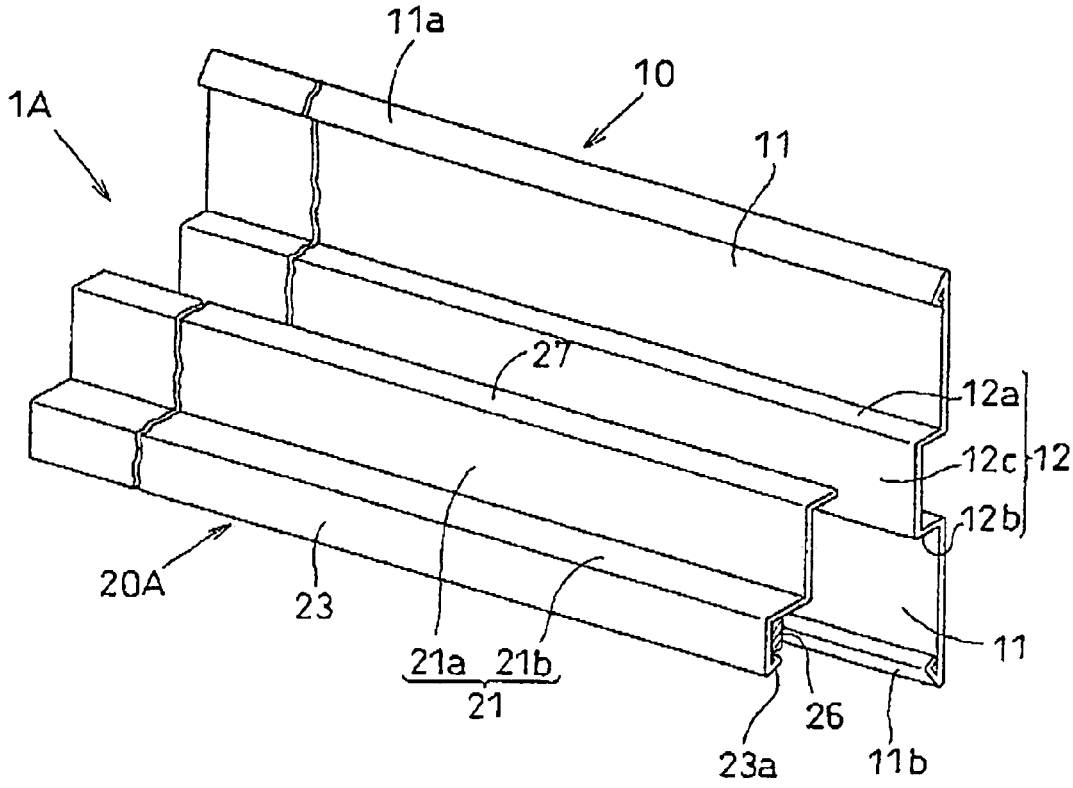
FIG. 3 is a perspective view showing a joint member according to another embodiment of the present invention.
Figure 4A:
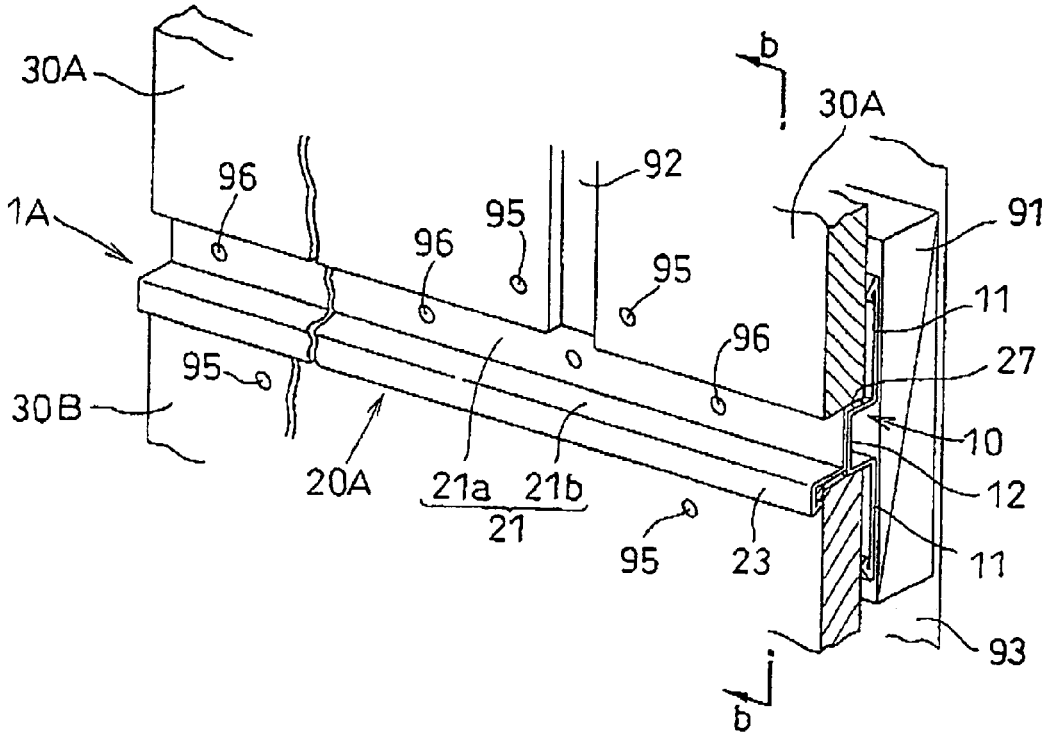
FIG. 4*a* is a perspective view showing a construction structure using the joint member shown in FIG. 3.
Figure 4B:
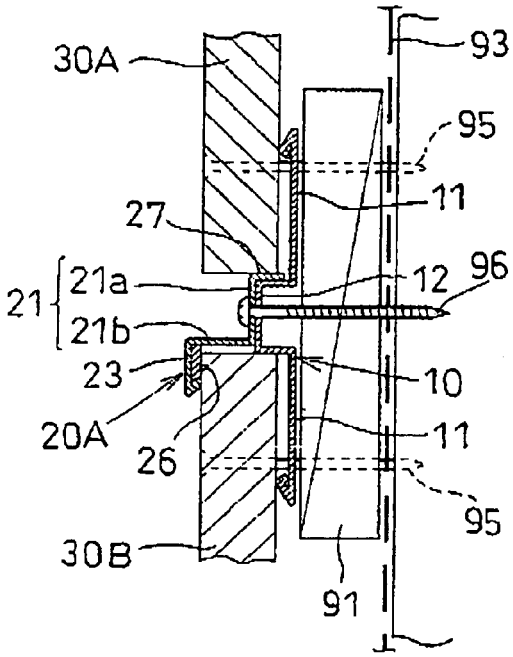
FIG. 4*b* is a cross sectional view taken along the line b-b shown in FIG. 4*a*.

FIG. 3 is a perspective view showing a joint member according to another embodiment of the present invention. FIG. 4*a* is a perspective view showing a construction structure using the joint member shown in FIG. 3. FIG. 4*b* is a cross sectional view taken along line b-b shown in FIG. 4*a*. Also in a joint member 1A according to the present embodiment, the same hat joiner 10 is used as the one shown in FIG. 1, except that a joint cover 20A is different from the one shown in FIG. 1. In other words, the joint cover 20A according to the present embodiment is not provided with the upper plate 21*c* and the upper edge portion 25 that are shown in FIG. 1. In their place, the joint cover 20A is provided with a projecting portion 27 extending from the upper end of the vertical plate 21*a* of the joint groove portion 21 to the rear surface side. This joint cover 20A is also made of a steel sheet by metal sheet processing. The projecting portion 27 is formed by folding down the upper end of the vertical plate 21*a* at right angle to the rear surface side. In addition, in the present embodiment as well, the elastic water proof material 26 is attached to almost throughout the rear surface of the lower edge portion 23.

The external wall construction method using the joint member 1A is described below. Like the case of the construction structure shown in FIG. 2, the upper end surface of the lower external wall panel 30B is brought into contact with the lower side surface 12*b* of the hat joiner convex portion 12, and the lower external wall panel 30B is caused to overlap from above the base plate 11 of the lower portion of the hat joiner 10. In this state, the nail 95 is driven from the surface side of the lower external wall panel 30B to fasten said panel to the lateral furring strip 91. Next, according to the present embodiment, the joint cover 20 is attached before the upper external wall panel 30A is done so. In other words, the projecting portion 27 of the joint cover 20A and the rear surface of the vertical plate 21*a* are brought into contact with the upper side surface 12*a* and the top surface 12*c* of the hat joiner convex portion 12, respectively, and the rear surface of the lower edge portion 23 is brought into contact with the surface of the lower external wall panel 30B. In this state, the screw 96 is screwed into the vertical plate 21*a* to fasten the joint cover 20A to the lateral furring strip 91. Subsequently, the upper external wall panel 30A is caused to overlap from above the base plate 11 above the hat joiner 10 to bring the lower end surface of the upper external wall panel 30A into contact with the projecting portion 27 of the joint cover 20. In this state, the nail 95 is driven from the surface side of the upper external wall panel 30A to fasten said panel to the lateral furring strip 91. In the external wall construction structure formed in this way, as shown in FIG. 4*a*, even if a vertical joint 92 is located above the joint member 1A, rain water falling along the vertical joint 92 may further flow down along the surface of the joint cover 20A, with the result that rain water does not stay near the joint member 1A.

Figure 5:
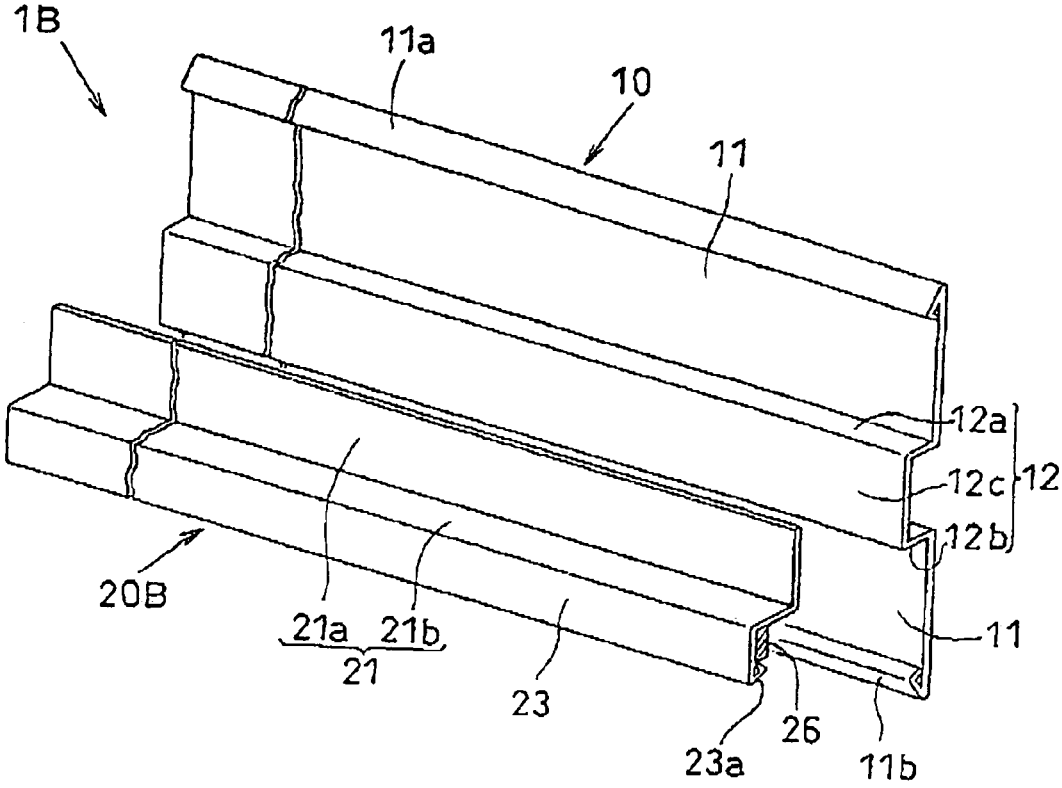
FIG. 5 is a perspective view showing a joint member according to still another embodiment of the present invention.

FIG. 5 is a perspective view showing a joint member according to still another embodiment of the present invention. In the joint member 1B according to the present embodiment, the joint cover 20B has a simple shape composed of the joint groove portion 21 made of only the vertical plate 21*a* and the lower plate 21*b*, and the lower edge portion 23, so that the joint cover 20B can be manufactured easily. In addition, also in the present embodiment, the elastic water proof material 26 is attached to almost throughout the rear surface of the lower edge portion 23. In the course of construction, either the joint cover 20B or the upper external wall panel may be fastened first, providing more freedom in construction.

Figure 6A:
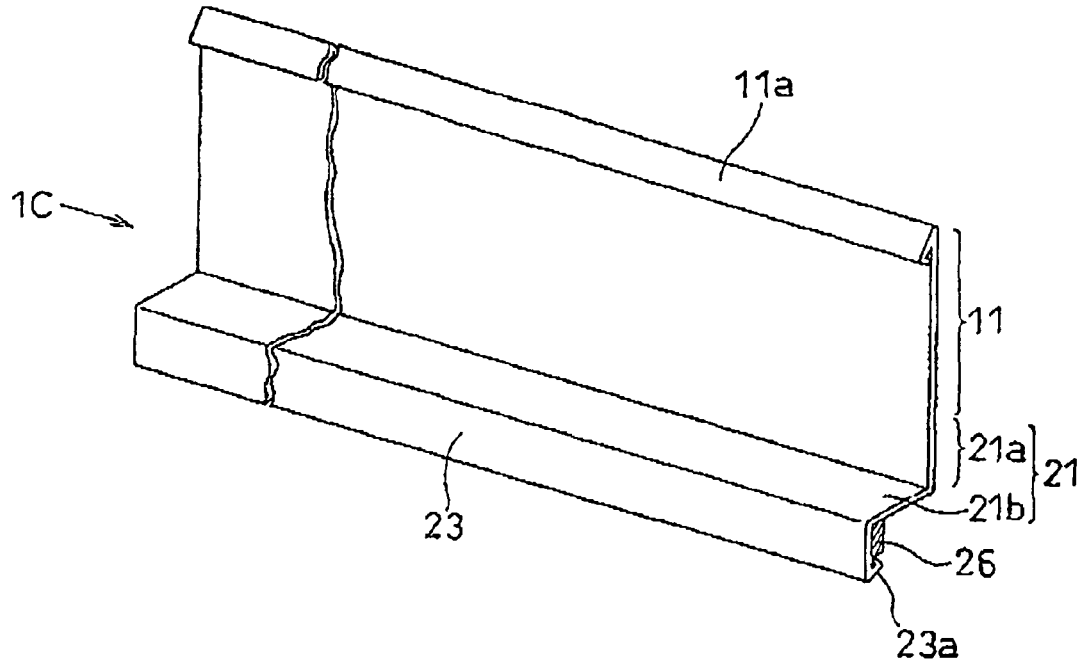
FIG. 6*a* is a perspective view showing a joint member according to still another embodiment of the present invention.
Figure 6B:
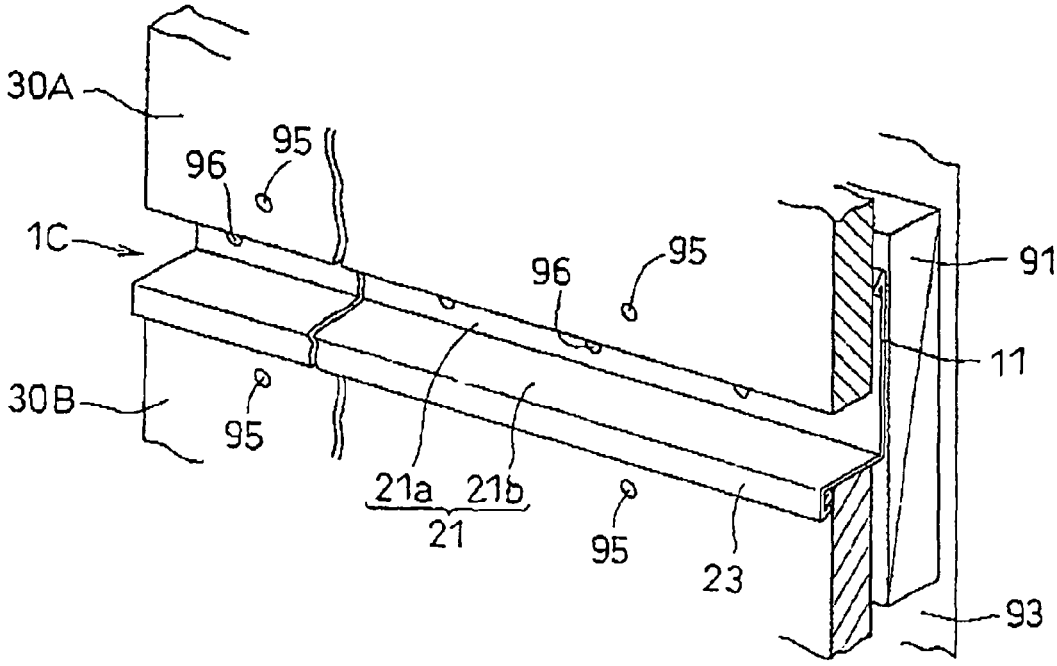
FIG. 6*b* is a perspective view showing a construction structure using the joint member shown in FIG. 6*a*.

FIG. 6*a* is a perspective view showing a joint member according to a further embodiment of the present invention. FIG. 6*b* is a perspective view showing a construction structure using the joint member shown in FIG. 6*a*. The above-descried joint members 1, 1A, and 1B are composed of two pieces that are the hat joiner and the joint cover. On the other hand, a joint member 1C according to the present embodiment is composed of a single piece and the joint member 1C can be manufactured at a lower cost. As shown in FIG. 6*a*, the joint member 1C is formed of a single steel sheet by metal sheet processing, and the joint member 1C is composed of the base plate 11 that serves as a fixed surface to the lateral furring strip 91, the joint groove portion 21 located below the base plate 11, and the lower edge portion 23 that extends from the lower end of the joint groove portion 21 to downward. The joint groove portion 21 is composed of the vertical plate 21*a* that is a continued lower portion of the base plate 11, and the lower plate 21*b* that is formed by bending the lower end of the vertical plate 21*a* to the surface side. The base plate 11 and the vertical plate 21*a* are formed as a continued flat plate. In addition, by bending the front end of the lower plate 21*b* downward, the lower edge portion 23 is formed, and the elastic water proof material 26 is attached to almost throughout the entire rear surface of the lower edge portion 23. The side end portions 11*a* and 23*a* of the base plate 11 and the lower edge portion 23 are folded down, respectively, to increase the strength.

In the course of construction, at first, the lower external wall panel 30B is fastened to the lateral furring strip 91 by using the nail 95. Next, the rear surface of the lower edge portion 23 of the joint member 1C is brought into contact with the surface of the lower external wall panel 30B, the screw 96 is screwed into the vertical plate 21*a*, and the lower external wall panel 30B is fastened to the lateral furring strip 91. Finally, with the upper external wall panel 30A positioned to give a certain interval between the upper external wall panel 30A and the lower external wall panel 30B, the upper external wall panel 30A is caused to overlap from above the base plate 11 of the joint member 1C and by means of the nail 95, the joint member 1C is fastened to the lateral furring strip 91. Further, the joint member 1C may be fastened to the lateral furring strip 91 by means of the nail driven into the base plate 11. However, as shown in FIG. 6*b*, by screwing the screw 96 at a position of the vertical plate 21*a* nearer to the lower edge portion 23, the elastic water proof material 26 attached to the rear surface of the lower edge portion 23 is sufficiently pressed against the external wall panel 30B improving the degree of adhesion.

Figure 7:
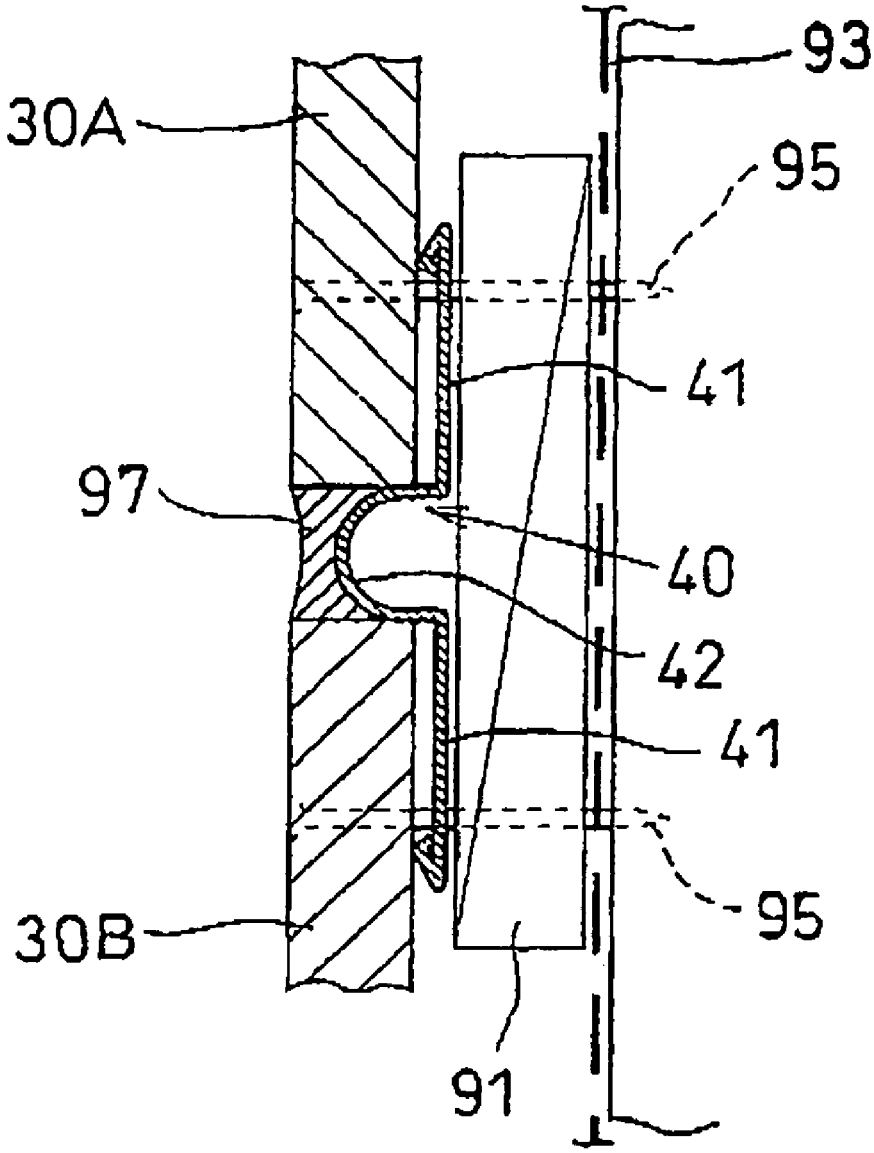
FIG. 7 is a perspective view showing an example of a construction structure of a conventional vertical joint portion.
Figure 8A:
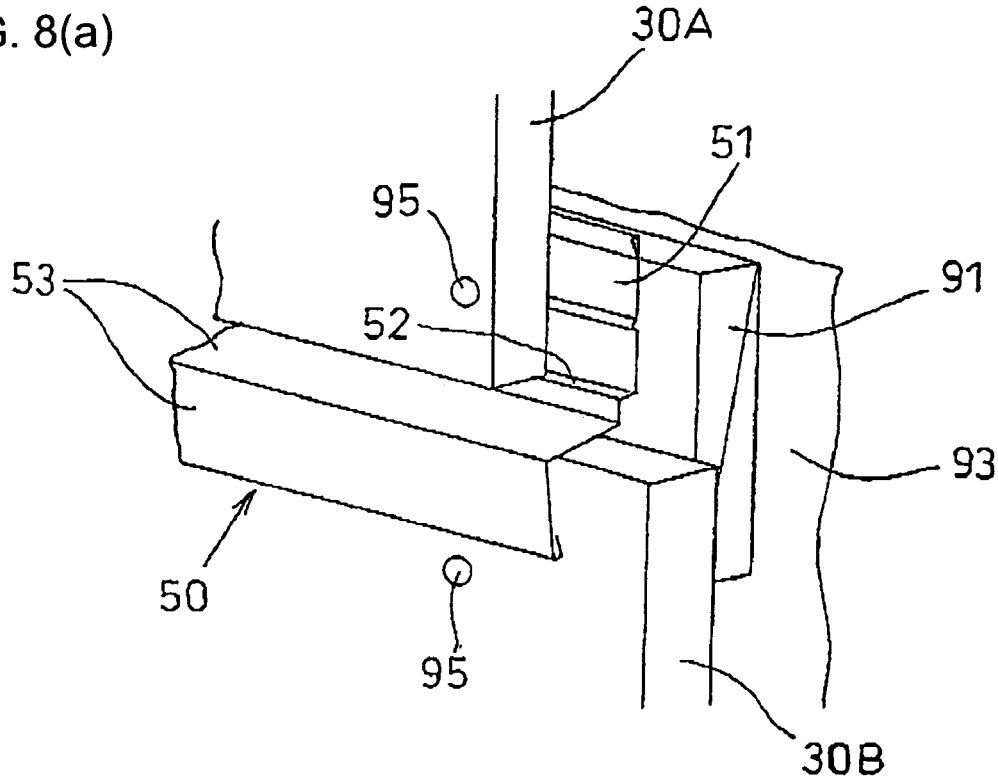
FIG. 8 is a perspective view showing another example of the construction structure of the conventional vertical joint portion.
Figure 8B:
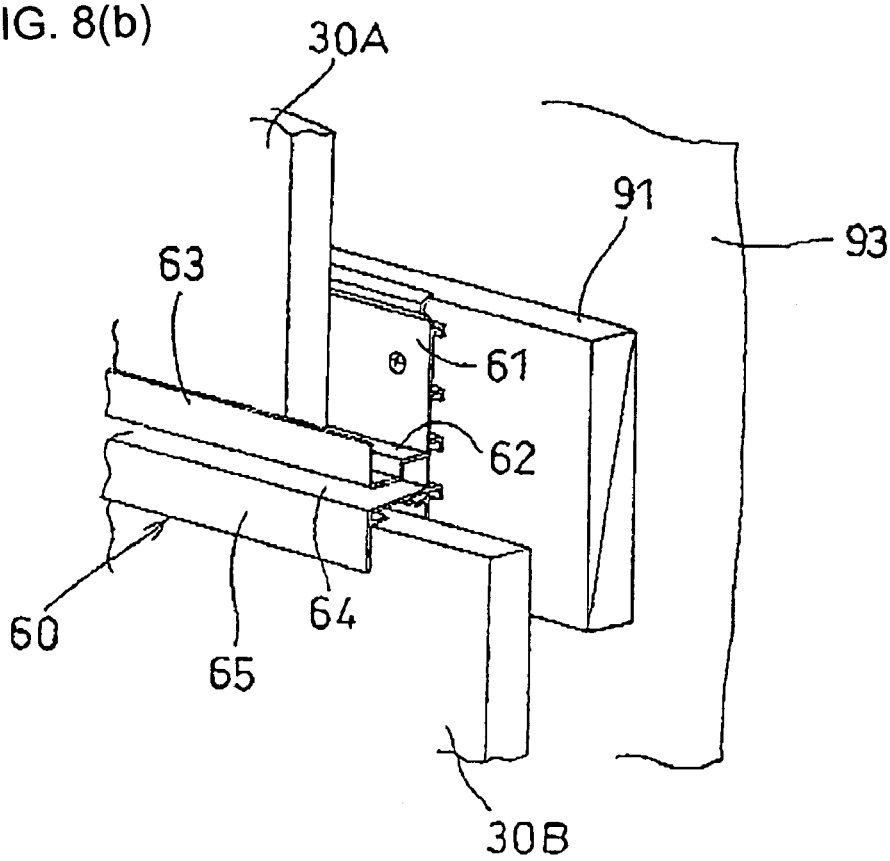

Various embodiments of the joint member according to the present invention are described above. However, the joint member according to the present invention may be modified into various embodiments other than these. For example, like the conventional hat joiner 40 shown in FIG. 7, the top surface of the hat joiner convex portion may be a curved surface. In addition, the upper plate and the lower plate of the joint groove portion may be inclined surfaces or the entire joint groove portion may be composed of continued curved surfaces. Further, on the top surface of the hat joiner convex portion or on the vertical plate of the joint groove portion, a ready hole for a screw may be formed in advance.

What is claimed is:

1. A joint member that is fixed between vertically adjacent external wall panels in an external wall construction for fastening the external wall panels to a side of a building frame by means of a fixture driven from a surface side, the vertically adjacent wall panels comprising an upper external wall panel and a lower external wall panel each having a front face, a rear face, an upper end surface and a lower end surface, the joint member comprising:

a hat joiner and a joint cover;

the joint cover comprising;

a substantially vertical lower edge portion that is brought into contact with the front face of a lower external wall panel in the course of construction, and a joint groove portion having flat upper and lower plates, the lower plate extends from an upper end of the lower edge portion to the rear face without contacting the upper end surface of the lower external wall panel, the hat joiner comprises a base plate that serves as a fixed surface to a side of the building frame, and a hat joiner convex part having upper and lower side surfaces, the hat joiner convex part protruding from the base plate to the front face and being sandwiched between the ends of the upper and lower external wall panels in the course of construction;

the joint groove portion is formed into a shape that covers at least a top surface of the hat joiner convex part and the upper end surface of the lower external wall panel with the joint member and the upper and lower external wall panels fastened to each other, and wherein the upper and lower plates of the joint groove portion are separated by a distance that is less than a distance separating the upper and lower side surfaces of the hat joiner convex part.

2. The joint member according to claim 1, wherein an elastic water proof material is attached to a rear surface of the lower edge portion.

3. The joint member according to claim 1, wherein the joint groove portion of the joint cover is formed in such a shape as to cover the lower end surface of the upper external wall panel in the state of the joint member and the upper and lower external wall panels being fastened to each other;

the joint cover is provided with an upper edge portion that extends upwardly from the upper end of the joint groove portion and is brought into contact the front face of the upper external wall panel in the course of construction; and an elastic water proof material is attached to the rear face of the upper edge portion.

4. The joint member according to claim 1, wherein the joint groove portion of the joint cover is formed in such a size as to enable part of the joint groove portion to be brought into contact with the top surface of the hat joiner convex portion in the state of the joint member and the upper and lower external wall panels being fastened to each other.

5. The joint member according to claim 4, wherein the joint groove portion of the joint cover is formed in such a shape as to cover the lower end surface of the upper external wall panel in the state of the joint member and the upper and lower external wall panels being fastened to each other; the joint cover is provided with an upper edge portion that extends from the upper end of the joint groove portion and is brought into contact with the front face of the upper external wall panel in the course of construction; and an elastic water proof material is attached to the rear face of the upper edge portion.

6. The joint member according to claim 3, wherein the hat joiner and the joint cover are respectively formed by the metal sheet processing of a single steel sheet.

* * * * *